US007261791B2

(12) United States Patent
Chaumat et al.

(10) Patent No.: US 7,261,791 B2
(45) Date of Patent: Aug. 28, 2007

(54) BOARD FOR GLIDING OVER SNOW WITH A DECORATIVE AND PROTECTIVE EXTERIOR ASSEMBLY, AND MANUFACTURING METHOD

(75) Inventors: Bernard Chaumat, Chirens (FR); Loic Chassouant, Izeaux (FR); Thierry Monnet, Izeaux (FR); Eric Restani, Voiron (FR)

(73) Assignee: Skis Rossignol S.A., Voiron (FR)

( * ) Notice: Subject to any disclaimer, the term of this patent is extended or adjusted under 35 U.S.C. 154(b) by 147 days.

(21) Appl. No.: 10/814,171

(22) Filed: Apr. 1, 2004

(65) Prior Publication Data

US 2004/0232594 A1 Nov. 25, 2004

(30) Foreign Application Priority Data

May 21, 2003 (FR) ..... 03 06073

(51) Int. Cl.

| | |
|---|---|
| ***B29C 45/00*** | (2006.01) |
| ***B29C 43/00*** | (2006.01) |
| ***A63C 9/00*** | (2006.01) |
| ***A63C 11/00*** | (2006.01) |

(52) U.S. Cl. ..... 156/245; 264/249; 264/297.2; 280/601; 280/607; 156/219; 156/220; 156/221; 156/222; 156/298

(58) Field of Classification Search ..... 441/68; 280/601, 607; 264/249, 297.2
See application file for complete search history.

(56) References Cited

U.S. PATENT DOCUMENTS

| | | | | |
|---|---|---|---|---|
| 4,386,982 | A * | 6/1983 | Weinhaus | 156/79 |
| 4,747,613 | A * | 5/1988 | Brichoud et al. | 280/611 |
| 5,016,901 | A | 5/1991 | Mayr | |
| 6,309,586 | B1 * | 10/2001 | Colley et al. | 264/510 |
| 6,478,917 | B1 | 11/2002 | Magoni et al. | |

FOREIGN PATENT DOCUMENTS

| | | |
|---|---|---|
| EP | 1 181 972 | 12/2001 |
| EP | 1 279 421 | 1/2003 |

OTHER PUBLICATIONS

FR-2823126, "Method of Manufacturing of A Snow-Glider With A Decoration and Protection Element", FR abstract FR20010004632 20010405, Oct. 11, 2002.

* cited by examiner

*Primary Examiner*—Justin R. Fischer
(74) *Attorney, Agent, or Firm*—Browdy and Neimark, PLLC

(57) ABSTRACT

A method for manufacturing a board for gliding over snow comprises producing a decorative and protective exterior assembly with at least one additional piece. At least one opening is made in the exterior assembly. The additional piece or pieces are placed on an outer surface of the exterior assembly, each piece having at least one through-fixing zone, passing through the opening or openings. The through-fixing zone or zones penetrate an inner structure of the board and constitutes one or more securing means for the piece or pieces.

8 Claims, 2 Drawing Sheets

BOARD FOR GLIDING OVER SNOW WITH A DECORATIVE AND PROTECTIVE EXTERIOR ASSEMBLY, AND MANUFACTURING METHOD

The invention relates to a method for producing a board for gliding over snow having a decorative and protective exterior assembly. The present invention also relates to a board for gliding over snow with an exterior face that comprises a protective film.

Decoration is an important criterion in marketing a board for gliding over snow, such as an alpine ski, a snowboard, a monoski, a cross-country ski, and the like. The decorative exterior assembly forming the upper part and sometimes the lateral parts is also for protecting the inner structure of the board. It must be of high quality, durable, resistant to exterior aggressive influences, and inexpensive. This exterior assembly has, in fact, to resist scratching, UV radiation, low temperatures, moisture, cleaning solvents, and the like.

PRIOR ART

It may be particularly advantageous to insert into the decorative and protective exterior assembly one or more pieces made from a material having different properties, in particular for a localized wear reinforcement or, alternatively, by way of example, in order to be able easily to hold one's gliding board with or without gloves, without having a sensation of cold or a smooth and slippery upper surface.

Document U.S. Pat. No. 6,478,917 describes a process for manufacturing a board for gliding over snow that comprises a protecting and decorative exterior assembly. Before the steps of molding the gliding board, the process comprises a step consisting in gluing at least one localized supplementary piece, positioned on the exterior surface, on a sheet that is to become the exterior assembly. Next, by compression in the mold, the supplementary piece is embedded in the sheet that is to become the exterior assembly so as to be flush with the final exterior surface of the gliding board.

Also known, from document FR-2 823 126, is a method for manufacturing a board, for gliding over snow, comprising, in particular, a step consisting in producing a decorative and protective exterior assembly, in which:

- at least one part cut out as a motif defined in the exterior assembly is provided;
- next, one or more pieces with dimensions smaller than or equal to those of the cut-out part or parts is positioned in the cut-out part or parts of the exterior assembly; and
- each piece is covered with one or more portions of a barrier polymer film having dimensions greater than those of the cut-out part or parts so as to guarantee the seal between the piece or pieces and the exterior assembly.

However, with these two methods, it turns out that the piece or pieces added to the surface of the decorative and protective exterior assembly are not fixed sufficiently securely. In fact, such pieces have to be able to withstand significant deformations, impacts and catching on the edges of other gliding boards, stones, branches, and the like, without being torn off.

Also known, from document EP-1 161 972, is a board for gliding over snow with a rail-type profile located on the top of the board. The rail-type profile extends in the lengthwise direction and serves to fix the functional elements such as, for example, the bindings, by means of snap-fitting into this profile.

The housings necessary for the snap-fitting, although not described fully in that document, appear to be obtained either at the time of molding, by deformation of the protective layer, or as a final operation, by machining of the board. In all cases, adhesion is obtained by gluing. This production method is complex, expensive and relatively unreliable.

SUMMARY OF THE INVENTION

The problem the invention proposes to solve consists in implementing a method for manufacturing a board for gliding over snow with a protective and decorative exterior assembly comprising one or more additional pieces very securely fixed to the structure of the board at the time the board is produced, i.e. without an operation of screwing, snap-fitting, or gluing onto a finished board. This method is also applicable either during a compression-molding operation or during an injection operation, the two methods being called hereinafter "subsequent steps of producing".

The invention thus relates to a method for manufacturing a board, for gliding over snow, comprising, in particular, a step, prior to the subsequent steps of producing the gliding board, consisting in manufacturing a decorative and protective exterior assembly, the exterior assembly being provided with at least one additional piece and then being positioned in a mold for the subsequent steps of producing the board.

In accordance with a first aspect of the present invention, the method is noteworthy in that the stages set cut below are also implemented. Firstly, the exterior assembly, having an outer surface and an inner surface, is produced. Next, at least one opening is made in the exterior assembly produced. And, lastly, the additional piece or additional pieces is or are placed on the outer surface of the exterior assembly, each piece having at least one through-fixing zone, passing through the opening or openings. This additional piece projects from the inner surface while the fixing zones penetrate into an inner structure obtained by the subsequent steps of producing the board so as to constitute one or more securing means.

In other words, with the through-fixing zone or through-fixing zones giving one or more securing means inside the inner structure of the gliding board, attachment between the additional piece and the gliding board is considerably enhanced. In the description that follows, "subsequent steps of producing" is understood to mean one or more steps constituting the compression-molding operation or the injection operation.

Provision may preferably be made beforehand for one or more recesses in the through-fixing zone or through-fixing zones of the additional piece or additional pieces. This may allow the filling of the recess or recesses with a material for binding the inner structure during the subsequent steps of producing the board. By virtue of the penetration of the material into this or these recesses, the piece can no longer be ejected.

According to a first operating method, the material for binding the inner structure may be a resin (if the subsequent steps of producing the board comprise, in particular, a compression-molding operation). According to a second operating method, the material for binding the inner structure may be a polyurethane foam (if the subsequent steps of producing the board comprise, in particular, an injection operation).

In order to promote yet further particularly resistant attachment of the piece or pieces, a phase, coming after the phase in which the additional piece or additional pieces is or are placed on the decorative and protective exterior assembly may be added, in which phase provision may be made in the through-fixing zone or through-fixing zones for at least one stop for preventing tearing-away of the additional piece or additional pieces. Favorably, the stop or stops provided in the through-fixing zone or through-fixing zones may be formed by one or more grooves. Preferably, the stop or stops provided in the through-fixing zone or through-fixing zones may be formed by one or more blocking wedges or washers set in the grooves or in the recess or recesses made previously. It is also possible to form the stop or stops provided in the through-fixing zone or through-fixing zones by means of one or more projecting elements produced by a punching operation in the groove or grooves or in the recess or recesses produced previously.

According to a second aspect of the invention, a board for gliding over snow, comprising, in particular, a gliding base, an inner structure, and a decorative and protective exterior assembly, the exterior assembly comprising, on its outer surface, one or more additional pieces each having at least one fixing zone, is noteworthy in that the fixing zone or fixing zones is or are a through-zone or through-zones, passing through the exterior assembly, projecting and penetrating into the inner structure of the board so as to constitute one or more means of securing by anchoring in the exterior assembly and/or in said inner structure.

BRIEF DESCRIPTION OF THE FIGURES

The invention will be properly understood and its various advantages and different characteristics will become better apparent during the following description of the non-limiting illustrative embodiment, with reference to the appended diagrammatic drawings, in which.

DETAILED DESCRIPTION OF THE INVENTION

Figure 1:
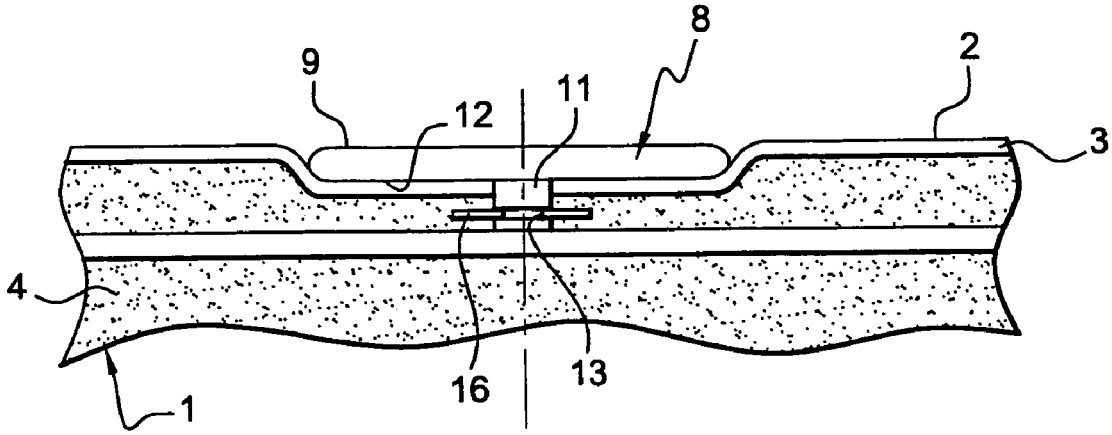
FIG. 1 shows a partial transverse sectional view of a ski, the protective and decorative exterior assembly of which is provided with an additional piece, in a first position.

A board for gliding over snow of conventional type, such as an alpine ski (1), comprises a front zone with a shovel, a rear zone with a tail turn-up, a central zone known as the "waist", an exterior face (2) forming the top and, optionally, the sides, and a face forming the gliding base delimited on either side by the two lateral edges (which are not shown). The ski (1) also comprises an inner structure (4) usually produced by means of a step of injecting a polyurethane foam into a corresponding mold, or, alternatively, by means of a compression-molding step. The exterior face (2) is formed by a protective and decorative exterior assembly (3) that has an outer surface (6) and an inner surface (7).

Figure 4:
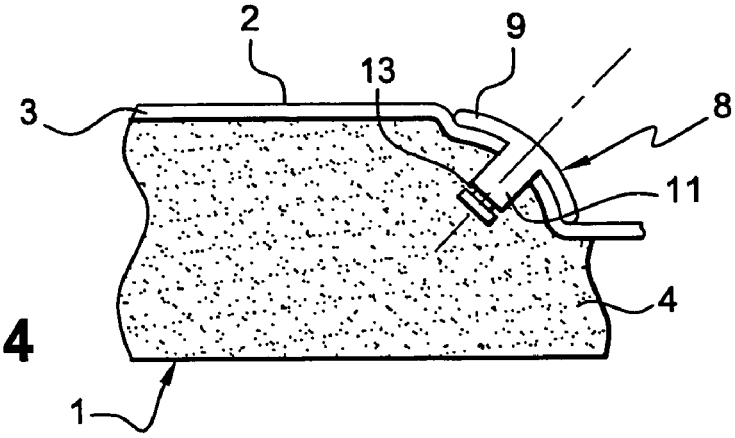
FIG. 4 shows a partial transverse sectional view of a ski with the piece inserted after the subsequent injection steps.
Figure 5:
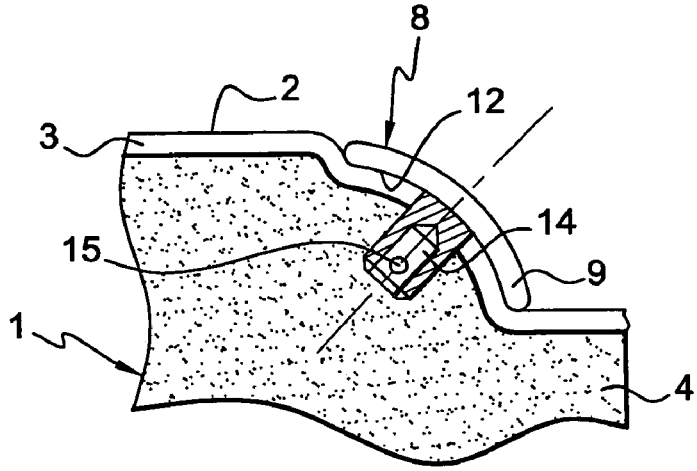
FIG. 5 shows a partial transverse sectional view of a ski, the protective and decorative exterior assembly of which is provided with an additional piece in a second position.
Figure 6:
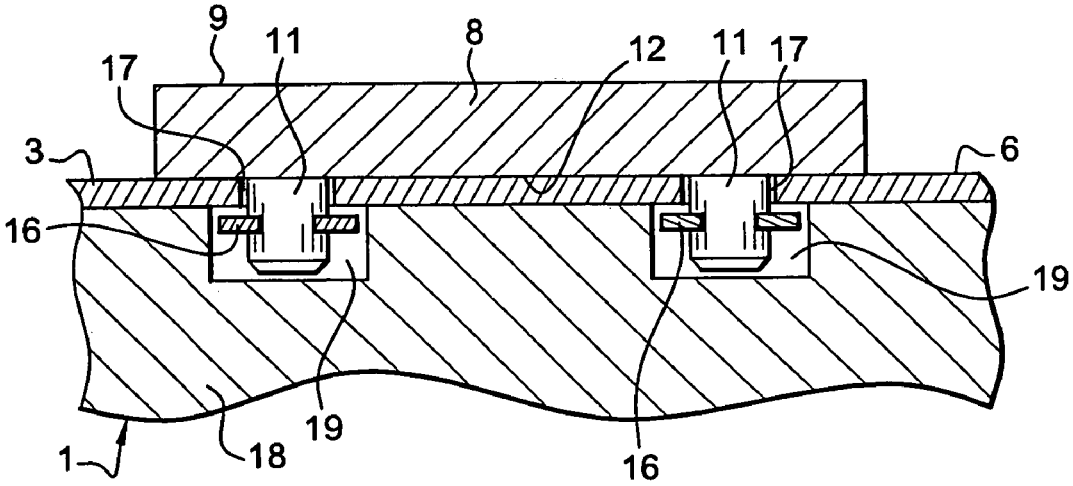
FIG. 6 shows a partial transverse sectional view of the ski, the protective and decorative exterior assembly of which is provided with an additional piece in a third position.

According to the invention, the ski (1) comprises an additional piece (8) that may be set (see FIGS. 1, 4, and 5) into the exterior face (2) of the ski (1) comprising the exterior assembly (3) or may be placed (see FIG. 6) over the exterior assembly (3). The additional piece (8) has an exterior shape (9) and a fixing zone (11).

Figure 2:
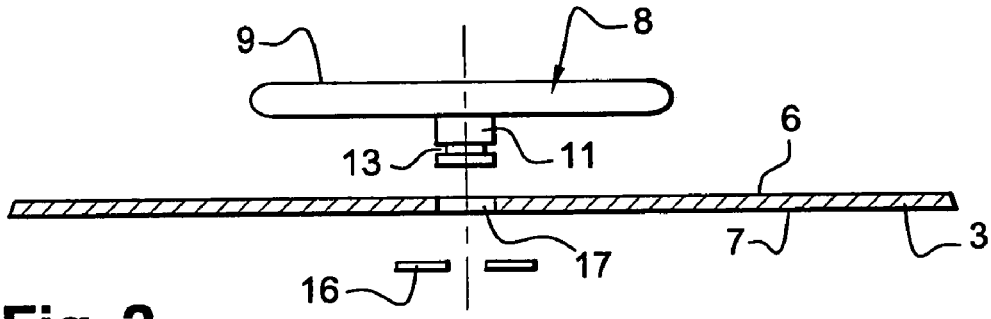
FIG. 2 shows an expanded view of the protective and decorative exterior assembly, with the piece according to FIG. 1 ready for insertion.
Figure 3:
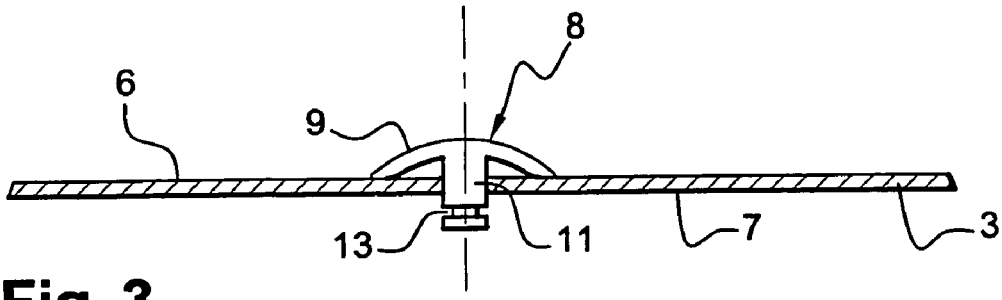
FIG. 3 shows a lateral view of the protective and decorative exterior assembly with a piece inserted.

The exterior shape (9) may be substantially planar (see FIGS. 1 and 2) or of more complex shape, particularly if it serves for guiding a binding element (front or rear binding). The exterior shape (9) is provided as a substantially rounded part (see FIGS. 3 to 5) if it is to be positioned on a rounded surface of the exterior assembly (3), for example in the case of "shell" skis.

Once the ski (1) is completed, the lower surface (12) of the piece (8) will be pressed against the outer surface (6) of the protective and decorative exterior assembly (3). According to a first embodiment (FIGS. 1, 4, and 5), the exterior shape (9) of the piece (8) is flush with the exterior face (2) of the ski (1). According to another embodiment (FIG. 6), the exterior shape (9) of the piece (8) is above the exterior face (2) of the exterior assembly (3).

The fixing zone (11) is deployed substantially perpendicularly relative to the exterior shape (9) or relative to the lower surface (12) of the piece (8). The fixing zone (11) has a substantially cylindrical protuberance with stops. These stops take the form of one or more grooves or recesses (13 and 14) made around the substantially cylindrical protuberance. By way of example (see FIG. 5), an axial recess (14), in the form of a blind hole, and a transverse recess (15), perpendicular to the axial recess (14), are made in the fixing zone (11). In a first embodiment (see FIGS. 4 and 5), the material forming the inner structure (4) will fill the groove or grooves (13) or, alternatively, the recesses (14 and 15). The groove or grooves and recess or recesses (13, 14, and 15) allow an increase in the area of contact between the material forming the inner structure and the piece (8). The piece (8) is much more difficult to tear away after molding.

In a second embodiment (see FIGS. 1 and 2), a means is provided, forming a stop in the form of an added washer (16) inserted in the groove (13). This washer (16) prevents an inopportune exit of the piece (8) from the front exterior assembly (3) during and after the molding operations. This washer may also be a pin, a peg, a wedge or a pin housed in one or more of the grooves (13) or in one or more of the recesses (14 and 15).

According to the invention, in the method for producing the ski (1) with the additional piece (8), the decorative and protective exterior assembly (3) is produced first. Then, at least one opening (17) is made through this exterior assembly (3) produced. Then, according to FIG. 3, the piece (8) is placed on the outer surface (6) of the exterior assembly (3). The fixing zone (11) will pass through the opening (17) in the exterior assembly (3). If appropriate, a washer (16) is snap-fitted to the rear of the piece (8) so as to lock the assembly between the piece (8) and the exterior assembly (3).

In the case of subsequent injection operations, the projecting part of the fixing zone (11) located inside the inner structure (4) will be surrounded by the polyurethane foam forming the core of the ski (1).

In the case of subsequent compression-molding operations, according to a variant of the method for producing the ski (1), a pre-machined core (18) comprising, in particular, blind cavities or holes (19) corresponding to each of the fixing zones (11) of the additional piece (8) is produced. The exterior assembly (3) is then placed over the pre-machined core (18). During molding, these holes (19) will be filled with binding resin.

The additional piece or additional pieces (8) may be:

a piece to strengthen against local wear; and/or a piece for making holding the ski more pleasant, by means of a better contact and/or by means of better adhesion, and the like; and/or a binding element, such as the base of the front or rear binding; and/or an element for receiving the binding, such as a rapid-positioning strip.

The present invention is not limited to the embodiments described and illustrated. A number of modifications may be made without thereby departing from the context defined by the scope of the set of claims.

The number of additional pieces (8) and of fixing zones (11) per piece (8) may vary. The shapes and the materials of the additional pieces (8) may be very different, depending on the manufacturer's wishes.

The invention claimed is:

1. A method for manufacturing a board (1) for gliding over snow, comprising the steps:

(a) producing a decorative and protective exterior assembly (3) having an outer surface (6) and an inner surface (7);

(b) making at least one opening (17) in the exterior assembly (3) produced;

(c) engaging an additional piece or pieces on the outer surface (6) of the exterior assembly (3), each additional piece or pieces projecting from the inner surface (7) and having at least one zone (11) that passes through the opening or openings (17);

(d) positioning the exterior assembly (3) with the additional piece or pieces (8) in a mold for the subsequent steps of producing the board (1) wherein the at least one zone (11) of the additional piece or pieces (8) penetrate an inner structure (4) of the board (1) so as to constitute one or more securing means having at least one zone (11), wherein the at least one zone (11) is a through fixing zone or zones, passing through the exterior assembly (3), projecting and penetrating into the inner structure (4) of the board (1) so as to constitute one or more means of securing by anchoring in the exterior assembly (3) and/or in said inner structure (4).

2. A method for manufacturing a board (1) for gliding over snow, comprising the steps:

(a) producing a decorative and protective exterior assembly (3) having an outer surface (6) and an inner surface (7);

(b) making at least one opening (17) in the exterior assembly (3) produced;

(c) engaging an additional piece or pieces on the outer surface (6) of the exterior assembly (3), each additional piece or pieces projecting from the inner surface (7) and having at least one zone (11) that passes through the opening or openings (17);

(d) positioning the exterior assembly (3) with the additional piece or pieces (8) in a mold for the subsequent steps of producing the board (1), wherein the at least one zone (11) of the additional piece or pieces (8) penetrate an inner structure (4) of the board (1) so as to constitute one or more securing means having at least one zone (11), wherein the at least one zone (11) is a through fixing zone or zones, passing through the exterior assembly (3), projecting and penetrating into the inner structure (4) of the board (1) so as to constitute one or more means of securing by anchoring in the exterior assembly (3) and/or in said inner structure (4); and wherein provision is made beforehand in the through fixing zone or zones (11) for fixing the additional piece or additional pieces (8) for one or more grooves (13) or recesses (14, 15) in order to allow the filling of the groove or grooves (13) or recess or recesses (14, 15) with a material for binding the inner structure (4) during the subsequent steps of producing the board (1).

3. The method as claimed in claim 2, wherein the material for binding the inner structure (4) is a resin if the subsequent steps of producing the board (1) comprise, in particular, a compression-molding operation, and wherein the material for binding the inner structure (4) is a polyurethane if the subsequent steps of producing the board (1) comprise, in particular, an injection operation.

4. The method as claimed in claim 2, wherein after the step of the additional piece or additional pieces (8) being placed in the opening or openings (17) of the exterior assembly (3) a provision is made in the through fixing zone or zones (11) for at least one stop or stops for preventing tearing-away of the additional piece or additional pieces (8).

5. The method as claimed in claim 4, wherein the stop or stops provided in the through fixing zone or zones (11) consist of one or more blocking wedges or washers (16) set in the groove or grooves (13) or in the recess or recesses (14, 15).

6. The method as claimed in claim 5, wherein the stop or stops provided in the through fixing zone or zones (11) consists or consist of one or more projecting elements produced by means of a punching operation in the groove or grooves (13) or in the recess or recesses (14, 15).

7. The method as claimed in claim 6, wherein the additional piece or pieces (8) will be set at least partially in the inner structure of the board (1) such that its or their exterior shape (9) is flush with the exterior face (2) of the gliding board (1).

8. The method as claimed in claim 2, wherein one or more openings (17), corresponding, respectively, with the through fixing zone or zones (11) is or are made in the exterior assembly (3).

* * * * *